US012789866B2

(12) United States Patent
Blum et al.

(10) Patent No.: US 12,789,866 B2
(45) Date of Patent: Nov. 10, 2026

(54) METHOD FOR CARRYING OUT A BRAKE TEST IN A RAIL-GUIDED VEHICLE ASSEMBLY, VEHICLE SUITABLE THEREFOR, COMPUTER PROGRAM AND COMPUTER-READABLE STORAGE MEDIUM

(71) Applicant: Siemens Mobility GmbH, Munich (DE)

(72) Inventors: Karsten Blum, Braunschweig (DE); Vladimir Okulevich, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 38 days.

(21) Appl. No.: 19/066,476

(22) Filed: Feb. 28, 2025

(65) Prior Publication Data

US 2025/0276724 A1 Sep. 4, 2025

(30) Foreign Application Priority Data

Feb. 29, 2024 (EP) ..... 24160599

(51) Int. Cl.
*B61L 15/00* (2006.01)

(52) U.S. Cl.
CPC ..... *B61L 15/0081* (2013.01)

(58) Field of Classification Search
CPC ..... B61L 15/0081
USPC ..... 701/32.8
See application file for complete search history.

(56) References Cited

U.S. PATENT DOCUMENTS

| | | | | |
|---|---|---|---|---|
| 9,187,074 | B2 | 11/2015 | Herden et al. | |
| 9,284,048 | B2 * | 3/2016 | Harrigan | B64C 27/001 |
| 11,519,774 | B2 * | 12/2022 | Ronse | G01K 13/00 |
| 2010/0125117 | A1 | 5/2010 | Drews-Nicolai et al. | |
| 2014/0244080 | A1 | 8/2014 | Herden et al. | |

(Continued)

FOREIGN PATENT DOCUMENTS

| | | | |
|---|---|---|---|
| DE | 19833279 | A1 | 2/2000 |
| DE | 29824583 | U1 | 8/2001 |

(Continued)

*Primary Examiner* — Krishnan Ramesh
(74) *Attorney, Agent, or Firm* — Laurence A. Greenberg; Werner H. Stemer; Ralph E. Locher

(57) ABSTRACT

A brake testing method in rail-guided vehicle assemblies checks properly applied and released brakes. When applied, an actuator generates vibration in a vibratory system including brakes and wheels. A sensor records the vibration as a first measurement result for the applied state and subsequently an actuator generates vibrations in the released state. The vibration is recorded by the sensor as measurement result for the released state and a computer aids in comparison of first measurement results with first reference results for the released state and/or second measurement results with second reference results for the applied state and/or first measurement results with second measurement results and compares difference results with third reference results. Upon deviations outside a tolerance between measurement and/or difference results and associated reference results, a computer aides generating an error signal. A rail-guided vehicle, computer program and computer-readable storage medium are also provided.

14 Claims, 4 Drawing Sheets

(56) References Cited

U.S. PATENT DOCUMENTS

| | | | | |
|---|---|---|---|---|
| 2015/0105970 | A1* | 4/2015 | Harrigan | F16F 1/00 701/32.8 |
| 2020/0400486 | A1* | 12/2020 | Ronse | B61L 15/0081 |
| 2021/0078619 | A1* | 3/2021 | Morita | B61L 15/0027 |
| 2022/0397487 | A1* | 12/2022 | Samadani | B61K 9/04 |

FOREIGN PATENT DOCUMENTS

| | | | |
|---|---|---|---|
| DE | 102010025346 | B4 | 3/2012 |
| DE | 102011113090 | A1 | 3/2013 |
| DE | 102015004590 | A1 | 10/2016 |
| DE | 102020205928 | A1 | 11/2021 |
| EP | 2805859 | A | 11/2014 |
| EP | 3464000 | B1 | 5/2020 |
| JP | 2001158355 | A | 6/2001 |
| WO | WO 2010/057628 | A2 | 5/2010 |
| WO | WO 2018201171 | A1 | 11/2018 |

* cited by examiner

METHOD FOR CARRYING OUT A BRAKE TEST IN A RAIL-GUIDED VEHICLE ASSEMBLY, VEHICLE SUITABLE THEREFOR, COMPUTER PROGRAM AND COMPUTER-READABLE STORAGE MEDIUM

CROSS-REFERENCE TO RELATED APPLICATION

This application claims the priority, under 35 U.S.C. § 119, of European Patent Application EP 24160599.7, filed Feb. 29, 2024; the prior application is herewith incorporated by reference in its entirety.

FIELD AND BACKGROUND OF THE INVENTION

The invention relates to the following subject matter: a method for carrying out a brake test in a rail-guided vehicle assembly including a plurality of vehicles. Further, the invention relates to the following subject matter: a rail-guided vehicle in which wheels and brakes form a vibratory system. Further, the invention relates to the following subject matter: a computer program. Further, the invention relates to the following subject matter: a computer-readable storage medium for data.

In the field of freight train services of railroad companies, train formations are implemented on a needs basis by taking the respectively applicable train formation regulations into consideration. For that purpose, vehicles (freight cars) of different configurations and from different companies are also aligned transnationally and combined with power cars (one or more) to form a vehicle assembly.

Apart from connection to a coupling (currently not automatic), forming a freight train also includes connection of the braking system. The braking system in freight trains is operated by using compressed air. For that purpose, vehicles in the form of freight cars are equipped with a main brake air line which has to be connected from freight car to freight car. Reference is also made in this connection to a continuous brake since it is driven by a continuous main brake air line. An electrical connection between the freight cars is not required in that case and is currently not provided either.

In accordance with the German Allgemeines Eisenbahngesetz (AEG) [General Railway Act] part C. (Bau- and Betriebsrecht) [Construction and Operating Law] § 35 (Brakes of the trains), a brake test has to be carried out at least following a train formation, before the train is allowed to be set in motion. That action is currently carried out manually by a car technician establishing, in a first circumnavigation of the entire train, whether all brakes are applied and in a second circumnavigation, whether they have been released. That can take several hours, depending on the length of the train.

Freight cars have different braking systems. Fundamental differences are: shoe brakes, disk brakes and drum brakes, although drum brakes are virtually no longer used. Shoe brakes, by contrast, are very common.

Train testing currently takes place in a plurality of steps:

1st step: The drop in pressure in the main brake air line is checked. This is not allowed to undershoot a particular value.

2nd step: The car technician carries out a first tour around the freight train and checks whether all brakes are released 3rd step: The train driver applies the brakes of the train 4th step: The car technician goes around the train again and checks whether all brakes are applied.

5th step: The train driver releases the brakes of the train

6th step: The car technician goes around the train again and checks whether all brakes are released.

German Patent Application DE 198 33 279 A1 describes a facility for monitoring train integrity, and checking the brake test in locomotive-hauled trains. In that case, sensors for ascertaining the pressure in the brake line operated with air are used in the locomotive. German Utility Model DE 29 824 583 U1 also describes a facility for monitoring the train integrity and checking the brake test in locomotive-hauled trains in which the pressure in the central brake air line is checked. However, that method is very laborious. Furthermore, it is only possible to make a statement about the braking function for the entire train.

German Patent DE 10 2010 025 346 B4 relates to an apparatus and a method for controlling a mobile brake test device using a radio remote system. With that technical solution, remote-controlled motor units are provided on each car of the train, with it being possible for them to perform brake testing. However, the mechanical effort is considerable, and the risk of malfunctions is high. German Patent Application DE 10 2015 004 590 A1 relates to brake testing of freight trains. The pressure ratios of a main brake line and of a brake air line and, in addition, in the brake cylinders are tested. Furthermore, the setting of a parking brake in the individual cars is monitored. That technical solution is also associated with considerable mechanical effort.

International Publication WO 2018/201171 A1 relates to a method for carrying out an automatic brake test on trains and cars suitable therefor. Each car is equipped with an evaluation unit. The brake cylinder pressure and the braking force induced by the brake cylinder pressure are metrologically detected on each car, evaluated by the evaluation unit and transferred to a central device. Sensors are also still present in that solution for measuring the braking force, and they further increase the complexity of the apparatus for the automatic brake test in relation to the solution.

European Patent Application EP 2805859A relates to a facility and to a method for carrying out guided brake tests on rail vehicles in which a mobile device on the last car of the train can measure the pressure in the main pressure line and transfer it to another device. It can also be fastened as a coupling head to the last car in accordance with European Patent Application EP 2805859A1. However, in freight trains there is the problem of the energy supply to that additional device. European Patent EP 3464000B1 relates to a method and to an apparatus for automatically testing brakes of a railbound vehicle using optical fibers.

An adverse effect of shoe brakes is that the wheel is put under severe strain due to the friction of the metal brake shoes or brake pads. The running surface which is roughened thereby generates a loud rolling noise which becomes louder as the speed increases. Furthermore, vibrations occur due to the uneven or rough surface, which put the wheel as well as the track facilities under strain. In the extreme case those vibrations can result in the wheel breaking. International Publication WO 2010/057628 A2 describes a measuring method in which the operational vibrations can be detected during travel of the train in order to identify uneven or rough surfaces of the wheels and of the operating state of a released or applied brake by way of a vibration sensor fixed to the axle.

SUMMARY OF THE INVENTION

It is accordingly an object of the invention to provide a method for carrying out a brake test in a rail-guided vehicle assembly, a vehicle suitable therefor, a computer program and a computer-readable storage medium, which overcome the hereinafore-mentioned disadvantages of the heretofore-known methods, vehicles, computer programs and storage media of this general type, and with which the practicability of an automatic brake test can be expanded and carried out with sufficient reliability.

With the foregoing and other objects in view there is provided, in accordance with a first aspect of the invention, a method for carrying out a brake test in a rail-guided vehicle assembly composed of a plurality of vehicles, in which it is checked whether the brakes of the vehicle assembly may be properly applied and released.

The brake test to be carried out is the brake test provided on the basis of the operating regulations, as already explained above. This brake test also has to take place, in particular, before initial operation of a vehicle assembly, after its formation.

An apparatus, if it has at least one computer or processor, or a method, if it uses at least one computer or processor which executes at least one method step of the method, is computer-aided or computer-implemented.

A computing environment is an IT infrastructure composed of functional components such as processors, memory units, programs and data to be processed by the programs, which are used to execute at least one application which has a task to fulfil. Further functional components can be composed of sensors and actuators which allow the computing environment to interact with the outside world. The IT infrastructure can also be organized as a network of the functional components.

A Cloud (also referred to as a computer cloud or data cloud) is a computing environment for so-called Cloud computing. What is meant is an IT infrastructure which is made available via interfaces of a network such as the Internet. As a rule, it includes storage space, computing power or software as a service without these having to be installed on a computing entity that uses the Cloud. The services offered within the scope of Cloud computing include the complete spectrum of information technology and include, inter alia, the IT infrastructure, platforms, software and computing power, with the Cloud provider distributing the offered resources in line with demand to the Cloud users with the aim of optimally exhausting the resources thereby.

Since high safety standards with regard to function (operational safety, safety) as well as vulnerability (transmission security, security) of computer-implemented solutions apply in railroad engineering, the functionalities of a Cloud, which is used in railroad engineering, are customarily restricted with regard to their shared availability. In particular, restrictions are therefore necessary, and this concerns access of a potentially unrestricted circle of Cloud users. But access must also be restricted with a view to the required redundancy, and this concerns the sharing of computing resources by different computing entities. Technology which takes these railroad engineering restrictions into account will also be referred to as a private Cloud in connection with this invention even if a private Cloud fulfils the technical features connected with Cloud technology to only a limited extent.

Within a computing environment computing entities embody functional units which can be assigned applications (provided, by way of example, by a number of program modules) and can execute them. When executing the application these functional units form physically (for example computer, processor) and/or virtually (for example program module) self-contained systems.

Computers are electronic devices, composed of a plurality of functional components, with data processing properties. Computers can be, for example, clients, servers, handheld computers, communications devices and other electronic devices for data processing, which can have processors and memory units and can also be combined via interfaces to form a network.

Processors can be, for example, transducers, sensors for generating measuring signals or electronic circuits. A processor can be a Central Processing Unit (CPU), a microprocessor, a microcontroller, or a digital signal processor, possibly in combination with a memory unit for storing program commands and data. A processor can also be taken to mean a virtualized processor or a soft CPU.

Memory units can be configured as a computer-readable memory in the form of a main memory (Random-Access Memory, RAM) or data memory (hard disk or data carrier).

Program modules are individual software functional units which enable an inventive program sequence of method steps. These software functional units can be implemented in a single computer program or in a plurality of computer programs which communicate with each other. The interfaces realized in this connection can be implemented in terms of software within a single processor or in terms of hardware if a plurality of processors is used.

Interfaces can be realized in terms of hardware, for example cabled or as a radio link, or in terms of software, for example as an interaction between individual program modules of one or more computer program(s).

In order to prevent misunderstandings it should be noted at this point that individual features of the claims are consecutively numbered with small Latin letters without taking the numbering of the claims into consideration. This means that each letter occurs only once in the whole set of claims, and this enables unambiguous addressing of the relevant features of the claims without citing the claim number. However, for this reason the order of the letters is insignificant.

Inventively it is provided that:

in the applied state of the brake in each vehicle a) a vibration is generated in a vibratory system, which includes brakes and wheels of the relevant vehicle, by an actuator, b) the generated vibration in the relevant vibratory system is recorded by a sensor as a first measurement result for the applied state for the relevant vehicle, and subsequently in the released state of the brake in each vehicle c) a vibration is generated in the relevant vibratory system by the respective actuator, d) the generated vibration in the relevant vibratory system is recorded by the respective sensor as a measurement result for the released state for the relevant vehicle and e) with the aid of a computer each first measurement result is compared with a first reference result for the released state, and/or with the aid of a computer each second measurement result is compared with a second reference result for the applied state, and/or with the aid of a computer each first measurement result is compared with the relevant second measurement result and an ascertained difference result is compared with a third reference result for the difference, f) for the case where a deviation, which lies outside of an admissible tolerance range, is established between one of the measurement results and/or the difference results as well as the associated one of the reference results, an error signal is generated with the aid of a computer.

In the present description of the invention, a distinction is made between first measurement results for the applied state of the brake and second measurement results for the released state of the brakes. A distinction is accordingly also made between first reference results for the applied state of the brake and second reference results for the released state of the brake. In addition, a distinction will be made in the following between first error results, second error results and third error results. Where reference is made in the context of this description of the invention without further details (in relation to first, second and third) of measurement results or reference results or error results, the statements associated therewith thus generally apply to the first and second measurement results or to the first, second and third reference results or to the first, second and third error results equally.

The error signal can be used in different ways in a manner known per se. For example, it can be used to output an error with the aid of a suitable output apparatus such as a warning light or a screen. However, an error signal can also be processed with the aid of a computer in order to trigger an automatic reaction in the inventive method. For example, the moving-off of a tractive unit for the vehicle assembly can be blocked in the presence of an error signal.

The vibration is generated by an actuator and measured by a sensor. This means that the actuator has to be suitable for generating and the sensor for measuring vibrations respectively. This does not necessarily mean the actuator and the sensor are two different components. It is also conceivable that, for example, a piezo crystal is used as the actuator in order to initiate a vibration in the vibratory system and the same piezo crystal is subsequently excited by a vibration response and records this response as a sensor. This statement applies to all types of vibration transducer, which can convert energy into vibrations as well as convert vibrations into energy.

The invention makes use of the recognition that the vibratory system, which includes the brakes as well as the wheels of the vehicle, as a function of whether the brakes are applied or released, has different vibration properties which may be metrologically detected.

However, it is such that the automatic brake test should be carried out, in particular, before commencement of travel or also during stoppages when the vehicle is therefore currently on the track and consequently no dynamic stresses of the vehicle assembly result in vibrations. This is where the inventive idea that an actuator is used, which generates vibrations in the vibratory system, comes into play. In addition this has the advantage that these vibrations represent a known variable with which the vibratory system is excited. The vibration response of the vibratory system can also be predicted more effectively thereby. Dynamic stresses, which generate vibrations, which are to be analyzed, during operation of the vehicle assembly, are significantly more difficult to estimate by comparison, for which reason the vibration response is also more difficult to evaluate.

It is known that vibrations can be described by different characteristic properties. These include, for example, the vibration amplitude, the vibration frequency, the vibration profile including the decay behavior (influenced by the damping of the vibratory system) and a vibration spectrum, which can be obtained by analyzing the vibration profile, for example by way of a Fourier transform. The inventively generated measurement result can be advantageously evaluated with regard to at least one of the aspects. The same applies to the inventive difference result. The reference results describe a measurement result that is to be expected under particular conditions (for example, applied brake or released brake). Certain deviations from this measurement result are tolerated in a comparison, with this deviation being defined by a specified tolerance range.

One advantage of the invention resides in that an actuator for generating vibrations is provided in the vibratory system. This has two advantages in particular. Because the actuator can generate a vibration excitation with known energy content and with known characteristics, the evaluation of the vibration response is easier. It may, in particular, also be predicted more easily with a known excitation. In addition, the method of the automatic brake test can inventively also be applied when the vehicle assembly is at a standstill. This can only be achieved in that with the actuator an energy source is available for generating vibrations and for this reason no operationally occurring vibrations have to be available for evaluation. This can likewise be used if the brake test is carried out during travel of the vehicle assembly (for example, in order to check during operation that the brakes are still functioning reliably). However, the particularly attractive case of carrying out the brake test before initial operation, as legally required, may only be covered with the inventive use of the actuator. For this case it is particularly advantageous that the vibration generated by the actuator is not overlaid with operational vibrations, or at least is overlaid to only a small extent, and the vibration response in the examined vibratory system (composed of at least the wheels and the brakes of a vehicle) is therefore easier to analyze.

With the objects of the invention in view, there is also provided, according to a further aspect, a rail-guided vehicle in which wheels and brakes form a vibratory system, wherein the vehicle:

n) has a sensor for recording the vibration behavior of the vibratory system, o) forms a computing environment with a computer.

According to the invention, the aspects explained above are determined in that:

p) the computing environment is configured to execute the above-mentioned steps e) and f), q) the sensor is configured as a vibration transducer which can also be used as an actuator for generating a vibration in the vibratory system, wherein the vibration transducer is configured to execute the above-mentioned steps a) to d), or the vehicle has an actuator for generating a vibration in the vibratory system, wherein the sensor is configured to execute the above-mentioned steps b) and d) as described above and wherein the actuator is configured to execute the above-mentioned steps a) and c).

Because the functionality of the actuator is implemented in the vehicle, it is suitable for carrying out the method explained in more detail above. The advantages connected with the implementation of the method are achieved by the vehicle in the same way in this respect. For this purpose the vehicle is combined with other vehicles to form a vehicle assembly, with preferably all vehicles of the vehicle assembly being inventively equipped. The brake test can hereby be fully automated before initial operation of the vehicle assembly.

However, it should be noted that a vehicle assembly in which only some of vehicles are inventively equipped can also benefit from the inventive method. In this case a manual brake test only has to be partially carried out by staff, and this is based solely on those vehicles which cannot take part in an automatic brake test. However, this represents a time saving, so the advantages of the invention have an impact in this case too.

With the objects of the invention in view, there is furthermore provided, according to a further aspect, a computer program, comprising program commands which when the program is executed by a computer in a computing environment, prompt it to execute the steps e) and f) (see above).

With the objects of the invention in view, there is concomitantly provided a computer program product containing program modules with program commands, it being possible for the program modules to run on the same or a plurality of processor(s). The inventive method and/or its exemplary embodiments respectively can be implemented by using the computer program product, which can include one computer program or a plurality of computer programs, and with the implementation the above-described advantages are achieved.

According to a further aspect of the invention, a computer-readable storage medium for data is described, which stores datasets of the computer program product, as described in the last preceding paragraph.

Furthermore, an apparatus for storing and/or providing the computer program in the form of a computer-readable storage medium is thus described. The apparatus is, for example, a memory unit which stores the computer program and provides it for retrieval. Alternatively or in addition, the apparatus is a network service, a computer system, a server system, in particular a distributed, for example cloud-based computer system or virtual computer system, which stores the computer program on a computer-readable storage medium and preferably provides it in the form of a data stream.

The computer program is provided as a file in the form of program datasets that describe program modules, in particular as a download file, or as a data stream, in particular as a download data stream, of the computer program. The computer program is transferred into a computing environment, for example using the apparatus, so the inventive method can be executed in one computing entity or a plurality of computing entities of this computing environment.

General Exemplary Embodiments of the Invention

Variants that describe developments of the invention will be explained below without limiting the fundamental concept of the invention.

According to one variant, the aspects of the invention explained above are determined in that the actuator generates a specified vibration pulse as the vibration and the sensor subsequently records a pulse response of the vibratory system as the generated vibration.

It is advantageously possible to ascertain decay behavior of the vibratory system by initiating a vibration pulse and subsequent analysis of the pulse response. This allows, for example, statements to be made about the damping of the system since the vibration decays more quickly if the damping of the vibratory system is greater. It has been found in this connection that the damping of the vibratory system is greater when the brakes are applied than when the brakes are released, so a brake test can be carried out on the basis of the pulse response.

According to one variant, the aspects of the invention explained above are determined in that the actuator generates a specified vibration profile as the vibration and the sensor records a vibration response of the vibratory system during the generation of the vibration and/or subsequently as a generated vibration.

If a specified vibration profile is generated as the vibration, then it is possible to advantageously examine how the vibratory system responds to a periodic excitation (with constant or variable periods). For example, it is possible to select the specified vibration profile such that the excitation frequency constantly changes. The vibration response can then run through a resonance frequency of the vibratory system, with it being possible to ascertain this by way of a maximum of the amplitude of the vibrations of the vibratory system.

According to one variant, the aspects of the invention explained above are determined in that each measurement result is processed with the aid of a computer before carrying out step d) as described above.

The processing of the measurement results with the aid of a computer advantageously makes it possible to analyze particular properties of the vibratory system more effectively. These properties emerge more clearly due to the processing of the measurement results with the aid of a computer and can consequently also be identified with the aid of a computer when the relevant effect is less pronounced. The inventive method is thereby advantageously more sensitive to changes, such as the comparison of the vibratory system with applied or with released brakes.

Within the meaning of this description of the invention what is involved, even after the processing of the measurement result, is still the measurement result which is to be processed further. If a measurement result processed in this way is used step d), the reference results are of course likewise generated in a manner appropriate to the measurement result which is to be processed further. Only then can a computer-aided comparison of the measurement result, which is to be processed further, with the associated reference result be successful.

According to one variant, the aspects of the invention explained above are determined in that each measurement result is processed in such a way that it represents a measure of the resonance frequency of the vibratory system.

A measure of the resonance frequency is obtained, for example, if an excitation frequency of the excitation vibration generated by the actuator is continuously changed and the vibration response after the maximum vibration amplitude is sought in the measurement result. At this location the derivation of the amplitude profile after the time is zero. However, in such a method the resonance frequency would not be met exactly if the frequency of the excitation vibration did not continuously change very slowly. However, this would slow down the method and thereby make it uneconomical. However, the measure for the resonance frequency only has to be determined accurately enough for it to be possible to make a qualitative statement on whether the brakes are currently applied or released.

According to one variant, the aspects of the invention explained above are determined in that each measurement result is processed in such a way that it represents a frequency spectrum.

Frequency spectra can be obtained, for example, by way of a Fourier series transform. These allow comprehensive statements about the characteristics of the measured vibration. The characteristics of a vibration response when the brakes are applied could therefore be readily distinguished from a vibration response when the brakes are released here.

This examination method is advantageously also of such high resolution that, for example, it is possible to distinguish if not all brake linings have been released from a wheel in the relevant vibratory system (for example due to seizing of a brake lining). Similarly it is possible to ascertain if not all brake linings are applied in the relevant vibratory system (for example due to the loss of a brake lining). Thus when errors occur, further statements with regard to the error quality are possible.

According to one variant the aspects of the invention explained above are determined in that each measurement result is processed in such a way that it represents a measure of the damping of the vibratory system.

It has already been explained that the vibratory system has greater damping when the brakes are applied than when the brakes are released. The damping of the system can be determined in various ways. One possibility is to compare the decay behavior of the measurement with applied brakes (first measurement result) and the measurement with released brakes (second measurement result). A direct comparison of the measurement results is thereby possible in order to define the difference in a difference result. The decay behavior can be examined, for example, in such a way that the time requirement is measured until the amplitude vibration response has halved (the resulting measurement result would thus be an interval). Of course this is just one example. Reduction factors other an ½ can be selected.

According to one variant, the aspects of the invention explained above are determined in that:

g) as first reference results (RE1) and/or as second reference results (RE2) and/or as third reference results (RE3) for a specified large number of brake types or for a specified large number of pairings between brake types and vehicle types are created and h) for each vehicle a particular first reference result (RE1) and/or second reference result (RE2) and/or third reference result (RE3) is stored for retrieval when necessary by taking into account the brake type used in the vehicle or by taking into account the brake type used and also the vehicle type.

Where the relevant reference results are stored depends on the computing environment which is used for carrying out the inventive method. If the evaluation of the brake test is carried out, for example, by a telematic unit on the vehicle itself, the telematic unit can thus also provide a memory unit in which the required reference results can be stored in a manner specific to the vehicle. If a network solution is available, in particular a solution in Cloud technology, the reference results can also be stored centrally, with it being possible to assign them centrally to the relevant vehicles via car IDs, for example.

The great advantage of using individual reference results with regard to the brake type [individual] or with regard to the pairing of the brake type with the vehicle type, in which the relevant brake is installed, is as follows: it is thereby possible that improved approximation values are available for the expected amounts of the measured variables. It is hereby possible to confirm particular statements more reliably, especially the fact of the released state of the brake or the applied state of the brake. In this way it is also possible to improve the analysis already mentioned with regard to a partial application or partial release of the brake linings during the brake test.

Specifically, the use of the individual reference results also have an impact on the required tolerance ranges which are defined during implementation of the inventive method for reliable identification of errors. In general it can be the that the better the reference results are adapted to the individual circumstances present in the relevant vehicle, the smaller the tolerances which are to be taken into account can be selected. The smaller the tolerance range can be selected, the more reliably the automatic method for the brake test may be advantageously carried out.

According to one variant, the aspects of the invention explained above are determined in that:

i) a first reference result and/or a second reference result and/or a third reference result is individually ascertained for at least one vehicle and j) for each vehicle the ascertained first reference result and/or second reference result and/or third reference result is stored for retrieval when necessary.

Vehicle-specific ascertainment of a reference results means that it is possible to ascertain these results, independently of which brake type or vehicle type is used, by measurement with the available measuring accuracy. The safety when carrying out the automatic brake test can be advantageously improved further hereby. A further advantage resides in that a measurement of this kind can be repeated multiple times during the lifetime of the vehicle or the lifetime of the brake components installed in the vehicle. Changes (for example tunings) to the vibratory system (in particular the wheels and the brake linings or brake disks) due to signs of wear can be detected thereby and thus be compensated in future measurements.

Of course, the method of vehicle-specific creation of a reference result can also be combined with the method of using reference results that describe brake types and/or vehicle types. In this case it is possible that if, for example, a vehicle type has not yet been detected, an individual value is determined for it, whereas for vehicle types for which reference results are already available the available reference results are stored. In this case creating reference results is thus not necessary for an entire vehicle assembly, but at most for vehicles which it has not yet been possible to detect using the available reference results. Firstly, the effort for preparation of the brake test is thereby kept as low as possible, secondly, reliable implementation of the brake test is also possible for cars for which no suitable reference results have yet been detected. Advantageously, this thus yields an optimum with regard to the effort which is incurred, while simultaneously maintaining the highest requirements with regard to the functional reliability or operational safety.

According to one variant, the aspects of the invention explained above are determined in that:

k) first error results and/or second error results and/or third error results are stored for the occurrence of typical types of error which can be ascertained during the brake test, l) for the case where an error signal is generated in step f) (see above), with the aid of a computer the relevant first measurement result is compared with the first error results, and/or with the aid of a computer the relevant second measurement result is compared with the second error results, and/or with the aid of a computer the ascertained difference result is compared with the third error results, m) for the case where a match is established between one of the measurement results and/or one of the difference results and an associated error result in the context of specified deviations, an error message describing the relevant type of error is generated with the aid of a computer.

Error results within the meaning of this description of the invention should in essence be taken to mean results which are comparable with the reference results which have already been explained. In this connection the error results describe the properties of measurement results which are not metrologically incorrect themselves but (correctly) describe an error that has occurred, which is actually present in the braking system. In this way it is advantageously possible not only to ascertain that there is an error present in the braking system but to also identify this error if it matches an error result.

An error message directed at the identified type of error can be output, for example, for the train driver or to a control center in order to make a decision with regard to further operation of the relevant vehicle assembly (train). The error message can also be used for maintenance work in order to carry out repairs in a targeted manner. Of course the error message can also be evaluated with the aid of a computer, for example by way of an automatic train control system, in order to initiate an automatic safety measure, such as emergency braking, for instance. This results in the advantage that it is possible to respond promptly to errors that occur in the braking system. The safety level in rail services benefits from this. It is also possible to identify errors earlier in order to rectify them before a safety risk occurs in the first place.

The specified deviations should be taken into account since measurement errors can also occur when assessing the error results. A tolerance range, as has already been described above, is thus involved. However, for the purpose of clear demarcation, specified deviations are referred to in connection with this tolerance range in the context of this description of the invention.

According to one variant, the aspects of the invention explained above are determined in that redundant actuators and/or sensors are used for each vibratory system of at least one of the vehicles.

Redundance when using sensors and actuators or transducers, which can be used as sensors and actuators, generates additional safety since when one device of the relevant redundancy pair fails, the brake test can continue to be carried out. The necessity of replacing the defective redundancy partner can be implemented, for example, in a corresponding error display if a self-diagnosis of the relevant redundancy partner is provided. Since the brake test is a safety-critical measure which is to be carried out after formations of vehicle assemblies in rail transport, the redundancy can achieve a specified level of safety (more on this below).

A further possibility of utilizing redundancy is carrying out voting in which only results which for the most part are considered to be matching are taken into account. The tolerances or specified deviations which have already been discussed can be taken into account here in order to decide whether compared results have to be considered as matching or not matching.

A comparator, also called a voter, is a facility for ascertaining a functionality of redundant systems. Voting systems, MooN systems for short, are assigned to the active redundancy (majority redundancy). They are used as measures to increase the error tolerance of systems for which a high level of functional safety (safety) against failure or occurrences of errors is demanded. There are different architectures of MooN systems. Practical applications are found in simplex (1oo2), duplex (2oo2), triplex (2oo3) and quadruplex (3oo4) architectures. The voter compares the results of the MooN systems in order to pass on the result of the majority. The result is passed on as long as at least M of the N systems are functioning (applies, for example, to hardware components and machines) or M of the N results match when compared (applies, for example, to data and measured values). Otherwise the whole system is deemed to have failed and an error can be output.

A voter can be implemented in terms of software or hardware. A voter implemented in terms of software is composed of a program module for the comparing, also called voting, which processes the above-mentioned results as inputs and generates an error or also a release as an output. In terms of hardware a voter can also be configured as an analog computer which carries out voting by way of a logical connection of the modules of the analog computer. In particular, a program module can also run on a processor which is itself not involved in generating the results. This produces a division in terms of hardware of the tasks for generating the results on the one hand and the evaluation of the results by way of comparison on the other hand. This has the advantage that the method steps of generating the results and of comparing the results are less likely to have an effect and consequently the operational safety of the process of comparison can be increased.

The requirements regarding the certification safety-relevant applications, for example in railroad engineering, are very high. According to the international standard IEC 61508 and, specifically for the rail sector, according to the European standard EN 50129, a distinction is made between four Safety Integrity Levels (SIL) or safety requirement levels for the required functional safety (safety) for safety functions. Safety Integrity Level 4 represents the highest and Safety Integrity Level 1 the lowest level of safety integrity. The respective Safety Integrity Level influences the confidence interval of a measured value to the extent that the higher the Safety Integrity Level is, which is to be met by the respective apparatus, the smaller the confidence interval is. The dimension of the functional safety of the various Safety Integrity Levels may be described in concrete terms by the expected frequency of failure of the safety-relevant system MTBF (Mean Time Between Failures), with this being given in years (a). With SIL-1 this lies in the region of 10 . . . 100 a, with SIL-2 in the region of 100 . . . 1,000 a, with SIL-3 in the region of 1000 . . . 10000 a, and with SIL-4 in the region of 10,000 . . . 100,000 a.

Other features which are considered as characteristic for the invention are set forth in the appended claims.

Although the invention is illustrated and described herein as embodied in a method for carrying out a brake test in a rail-guided vehicle assembly, a vehicle suitable therefor, a computer program and a computer-readable storage medium, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE FIGURES

Identical or corresponding elements of the drawings are each provided with identical reference numerals in the individual figures and will only be explained multiple times insofar as difference arises between the individual figures.

The exemplary embodiments explained below are preferred embodiments of the invention. In the exemplary embodiments the described components of the embodiments each represent individual variants of the invention which are to be considered independently of each other and which each develop the invention independently of each other too and should therefore also be regarded as an integral part of the invention individually or in a combination other than that shown. Furthermore, the described components can also be combined with the variants of the invention described above.

FIG. 3, including two partial

DETAILED DESCRIPTION OF THE INVENTION

Figure 1:
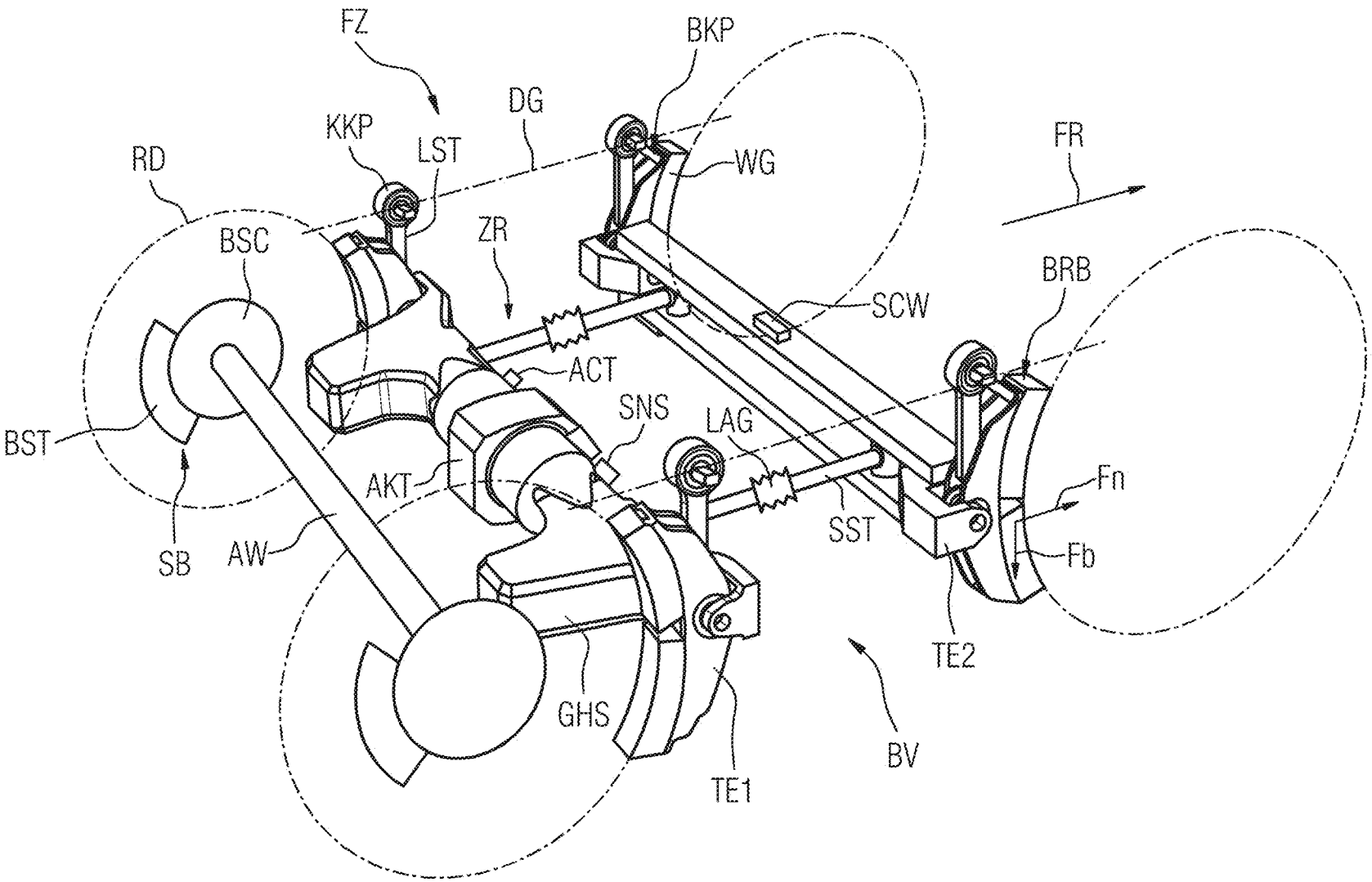
FIG. 1 is a diagrammatic, perspective view of an exemplary embodiment of the inventive apparatus (bogie as part of the vehicle with braking apparatus) with its interactions between the functional components which are used.

Referring now to the figures of the drawings in detail and first, particularly, to FIG. 1 thereof, there is seen a vehicle FZ by way of a schematically represented bogie DG, which bears the wheels RD in two axles of a twin axle. A braking apparatus BV disposed in a gap ZR of the axles is also schematically represented and this transfers a movement of an actuator AKT to the brake linings BRB, with the brake linings BRB acting with a normal force Fn on tires (not represented) of the wheels RD, resulting in a braking force Fb.

The braking apparatus BV is represented three-dimensionally with a first subunit TE1 and a second subunit TE2. The first subunit TE1 has a housing GHS which accommodates a mechanism (not represented) for transmitting the actuating motion of the actuator AKT which is similarly accommodated in the housing GHS. In a manner which is similarly not represented, the mechanism transmits an actuating motion to push rods SST which carry out at least primarily a translatory movement in order to enlarge or reduce a distance between the two subunits (TE1 . . . TE2).

The braking apparatus BV is suspended in the bogie DG with the aid of four bearing rods LST. For their part the bearing rods LST have spherical heads KKP which are fixed in the bogie DG in a manner known per se (not represented). The spherical heads KKP allow a movement predominantly in the horizontal direction, and, more precisely, in a direction of travel FR or counter to this direction of travel FR. The suspension mechanisms, which cannot be seen, of the bearing rods LST in the braking apparatus BV, describe arcs around the fixed points in the bogie DG defined by the spherical heads KKP. However, since the bearing rods LST are substantially vertically oriented, the technically relevant sector of a circle of these arcs substantially results in a horizontal movement. The spherical heads KKP also allow a certain amount of movement in the horizontal direction perpendicular to the direction of travel FR. However, this is limited constructionally by cheeks WG of brake heads BKP, which carry the brake linings BRB.

FIG. 1 also indicates, by way of example, an axle shaft AW connecting the wheels, which is provided with two brake disks BSC. In addition, the two associated brake calipers BST are schematically represented, and these have brake linings (not represented) which interact, in a manner likewise not represented, with the brake disks. The configuration of disk brakes SB is also known per se. The represented disk brake SB is thus to be understood as an alternative to the braking apparatus BV equipped with shoe brakes (brake linings BRB).

Although represented jointly in one figure, in reality conventionally only one of the two represented braking systems is used in one and the same vehicle FZ. However, it holds true for both braking systems that the wheels, the brakes and at least the bogie of the vehicle respectively form part of a vibratory system having a vibration behavior which can be recorded by a sensor SNS. A vibration can be generated in this vibratory system by using an actuator ACT for this purpose. FIG. 1 represents the sensor SNS and the actuator ACT as two separate assembly units. However, as an alternative a vibration transducer SCW can also be used which combines the function of the actuator ACT and the function of the sensor SNS (for example using a piezo transducer). FIG. 1 represents one of these too. The respective installation sites should be understood merely as examples. Other installation sites in the vehicle represented in FIG. 1 are likewise conceivable without questioning the functional principle.

Figure 2:
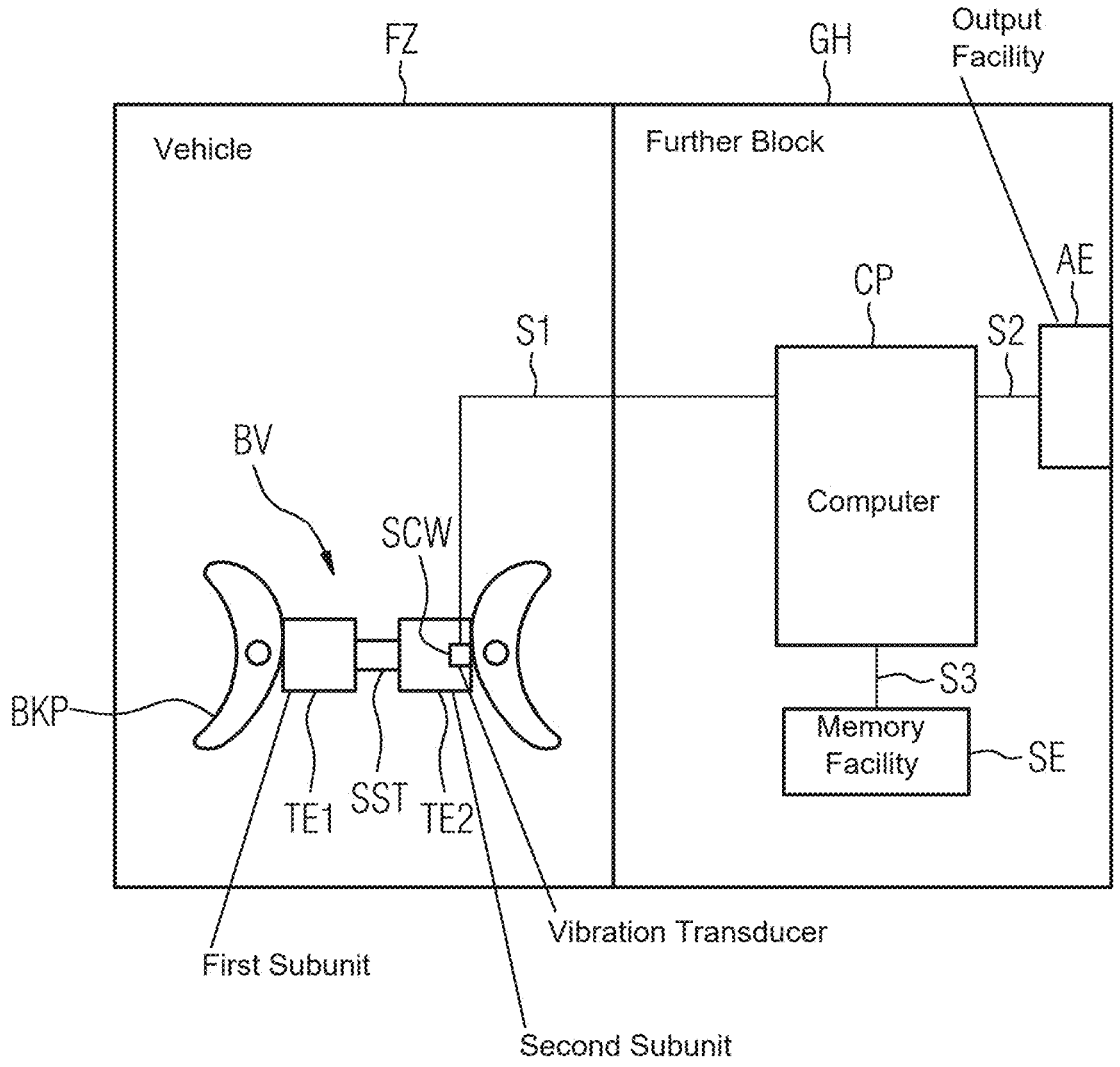
FIG. 2 is a diagram showing an exemplary embodiment of a computing environment for the apparatus according to FIG. 1 as a block diagram of the individual functional components and the interfaces formed between them, with individual computing entities executing program modules which can each run in one or more of the computer(s) represented by way of example and with it being possible for the interfaces shown to accordingly be configured in terms of software in a computer or terms of hardware between various computers.

FIG. 2 schematically represents the interaction of the functional elements involved in the inventive method as a block diagram. One block symbolizing the vehicle FZ which includes the vibration transducer SCW (the combination, shown according to FIG. 1, of sensor SNS and actuator ACT could equally be used, in a manner not represented) which is connected via a first interface S1 to a computer CP that is in turn connected via a second interface S2 to an output facility AE, in a further block GH. The braking apparatus BV in FIG. 1, by way of example, is represented in the vehicle FZ. Of course, the disk brake PSC according to FIG. 1 could also be used there.

The vibration transducer SCW is connected via the first interface S1 to the computer CP which evaluates the measurement results. The computer CP is connected, moreover, via a third interface S3 to a memory facility SE, with it being possible to store in the memory facility SE calculated reference results and error results for comparison with the recorded measurement results. The computer CP is connected to the output facility AE via the output or second interface S2, with the output facility AE preferably being a display which can represent items of information in respect of the operation of the brake, or system with, for example, a radio interface which can transmit the items of information directly to a central location, for example the locomotive or a control center (not represented). In the simplest case the output facility AE can be embodied by (at least) one light which without further items of information displays solely the need for maintenance (flashing when the brake linings BRB are worn beyond the wear limit, loss of brake shoes/ brake linings) and the current state of the brake (illuminated corresponds to applied/not illuminated corresponds to released).

Figure 3A:
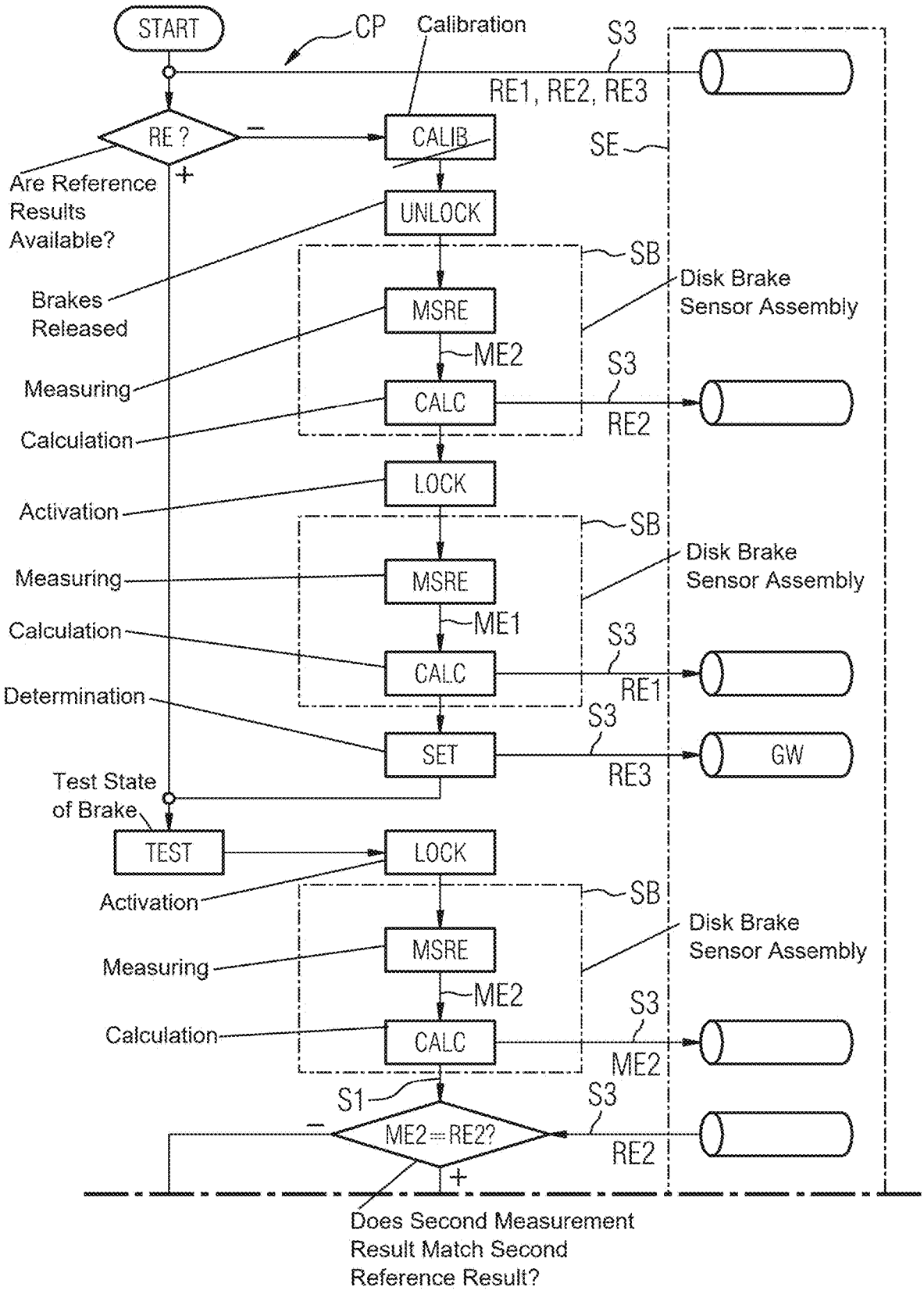
FIGS. 3A and 3B, is a flowchart showing an exemplary embodiment of the inventive method, it being possible for the method steps shown to be implemented individually or in groups by program modules and with the computing entities and interfaces according to FIG. 2 being indicated by way of example.
Figure 3B:
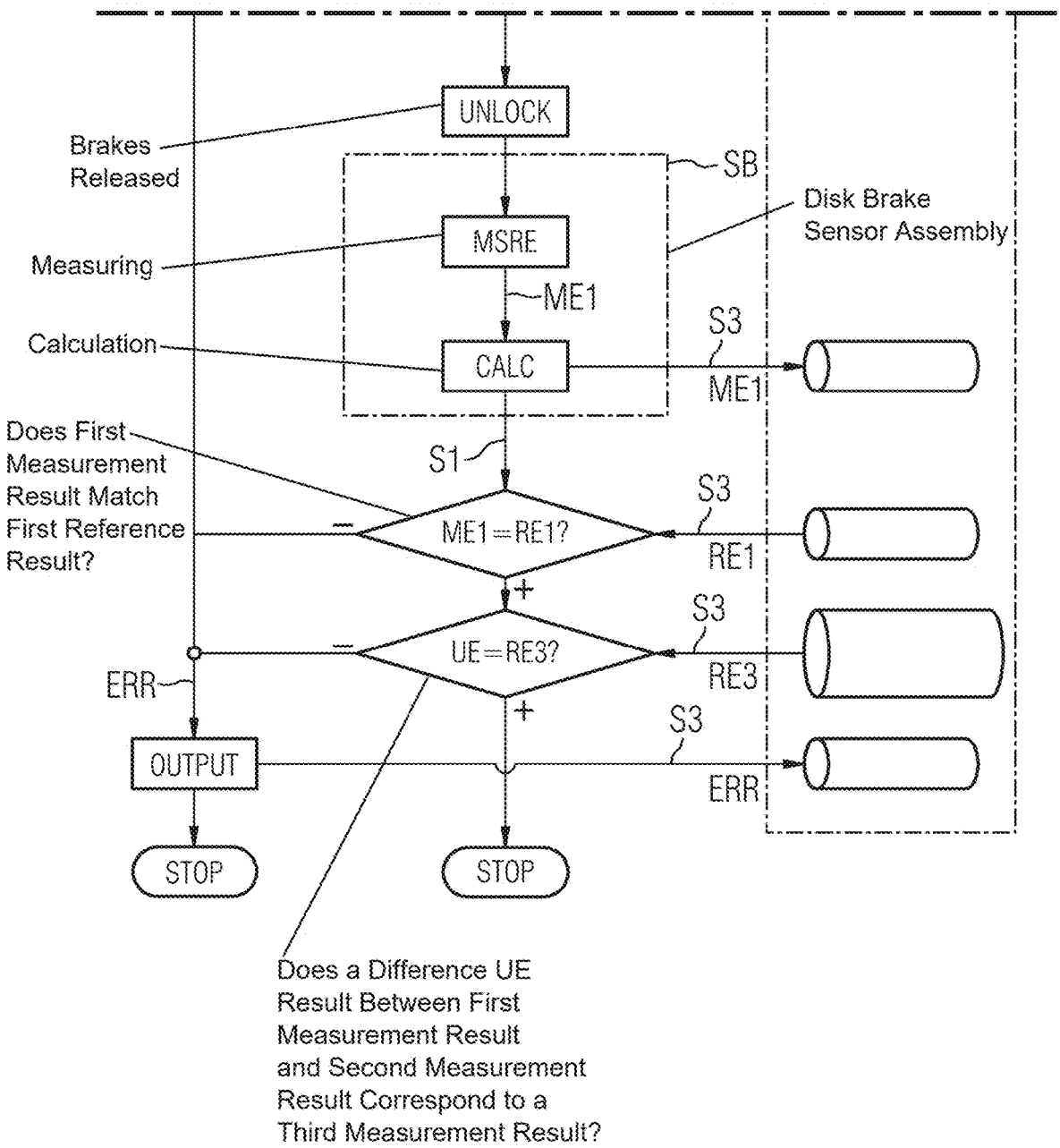

The inventive method will be explained by way of example below, in steps as represented in the flowchart according to FIG. 3. FIG. 3 also indicates the individual steps which can be carried out, by way of example, by boxes having functional components or computing entities according to FIGS. 1 and 2. Insofar as the interfaces according to FIGS. 1 and 2 are used, then these are also identified in FIG. 3.

The process sequence in the inventive measuring method may be inferred, by way of example, from FIG. 3. Once the method has been started, the available parameters are loaded from the memory facility SE. In a query step RE? it is checked whether the relevant reference results are already available. If not, it is an unknown combination of vehicle type and brake type, for which reference results do not yet exist, for which reason a calibration step CALIB is carried out.

During calibration the brakes are initially released in a deactivation step UNLOCK. A second measurement result ME2 is then generated in a measuring step MSRE. The missing second reference result RE2 is calculated from this in a subsequent calculation step CALC and is transferred into the memory facility SE.

The calculation of the reference results (if not yet available) is carried out in the exemplary embodiment according to FIG. 3 by a sensor assembly SB which also provides computing capacity (which assumes the functionality of the computer CP according to FIG. 2) for the calculation step CALC. However, this is only one exemplary embodiment. It is also possible for the measurement results to be transferred to the computer CP. This represents the configuration which was described according to FIG. 2. For FIG. 3 it holds true in this case that the system boundary indicated by the dot-dash line would be omitted for the sensor assembly SB without anything else relating to the procedure of the method changing.

In the next step an activation step LOCK takes place for the brake, so the brake linings abut the brake buffer (for example the wheels RD or the brake disk BSC). The measuring and calculation steps MSRE and CALC described above are repeated and supply the first reference result RE1 for the first measurement result ME1 (which with a configuration according to FIG. 2 is transferred by the computer CP to the memory facility SE).

In the following step it is possible, starting from the first measurement result ME1 and the second measurement result ME2 and knowledge of the circumstances of the brake system, which can be stored in terms of formula in the memory facility SE, to calculate the third reference result RE3 in a determination step SET (and with a configuration according to FIG. 2 can be transferred by the computer CP into the memory facility SE).

If reference results already exist (or following conclusion of their calculation), the calibration step CALIB can be omitted and a test step TEST takes place to check the state of the brake. For this purpose an activation step of the brake LOCK is carried out if it has not yet been applied. The second measurement result ME2 is then measured and possibly calculated MSRE, CALC by the sensor assembly SB, as already outlined above. The current brake result can then be transferred (in the case of a configuration according to FIG. 2, by the computer CP to the memory facility SE). The computer CP then checks whether the second measurement result ME2 matches the second reference result RE2 in the context of the tolerance requirements. The second reference result RE2 is read from the memory facility SE for this purpose. For the case where it is not possible to establish a match, an error signal ERR is output in an output step OUTPUT, and this can be sent directly to the output facility AE according to FIG. 2 or can be stored as an error signal ERR in the memory facility SE in order to be displayed later. For the alternative case, the procedure is as follows:

The procedure described above is repeated with released brakes. A deactivation step of the brake UNLOCK is carried out for this purpose. The first measurement result ME1 is then measured and possibly calculated MSRE, CALC by the sensor assembly SB, as already outlined above. The current braking result can then be transferred (in the case of a configuration according to FIG. 2, by the computer CP to the memory facility SE). The computer CP then checks whether the first measurement result ME1 matches the first reference result RE1 in the context of the tolerance requirements. The first reference result RE1 is read from the memory facility SE for this purpose. For the case where it is not possible to establish a match, the error signal ERR is output in an output step OUTPUT, and this can be sent directly to the output facility AE according to FIG. 2 or can be stored as an error signal ERR in the memory facility SE in order to be displayed later. For the alternative case the procedure is as follows:

In addition or optionally, it can be checked in a query whether a difference (expressed by a difference result UE) between the first measurement result ME1 and the second measurement result ME2 corresponds to a third reference result RE3. This can be, for example, a difference in the damping of the vibratory system in the applied state of the brake and in the released state of the brake. If this difference in damping is not attained (that is to say, it is greater or smaller), this can be an indication, for example, that the brakes may be applied and released but a brake lining is missing, so the system has different properties with applied brakes than if all brake linings were still present. This example shows that the additional check explained here also makes additional statements possible which go beyond the preceding statements. When necessary, an error ERR can be output in the manner described above in this case too.

A more extensive check of the error signals ERR is not represented in FIG. 3, with it being possible to compare the measurement results or difference results with error results for this purpose. These error results can also be stored in the memory facility in the same way as the measurement results and difference results UE, with the more extensive examination being performed by the computer in a manner which is not represented. The analysis of the quality and/or quantity of the errors then permits additional statements, such as the one already mentioned above about the loss of a brake lining. Valuable insights can be obtained hereby as to whether, on the basis of the generated error signal ERR, further operation of the relevant vehicle must be stopped immediately (in the case of complete failure of the brake) or only maintenance must be carried out in the near future (for example in the case of advanced wear to the brake linings).

The following is a summary list of reference numerals and the corresponding structure used in the above description of the invention:

ACT actuator
AE output facility
AW axle shaft
BKP brake heads
BRB brake linings
BRB brake lining BSC brake disks
BST brake calipers
BV braking apparatus
CALC calculation step
CALIB calibration step
CP computer
DG bogie
DG bogie
ERR error signal
Fb braking force
Fn normal force
FR direction of travel
FZ vehicle
GH further block
GHS housing
KKP spherical heads
LAG length adjustment
LOCK activation step for brakes
LST bearing rods
ME1 first measurement result
ME2 second measurement result
OUTPUT output error signal
RD wheel
RE1 first reference result
RE2 second reference result
RE3 third reference result
S1 . . . S3 interface
SB disk brakes
SCW vibration transducer
SE memory facility
SET determination step
SNS sensor
SST push rods
TE1 first subunit
TE2 second subunit
TEST test step
UE difference result
UNLOCK deactivation step for brake

The invention claimed is:

1. A method for carrying out a brake test in a rail-guided vehicle assembly including a plurality of vehicles, for checking whether brakes of the vehicle assembly may be properly applied and released, the method comprising:

in an applied state of the brakes in each vehicle:

a) using an actuator to generate a vibration in a vibratory system including brakes and wheels of a relevant vehicle;

b) using a sensor to record the generated vibration in the relevant vibratory system as a first measurement result for the applied state for the relevant vehicle;

and subsequently in a released state of the brakes in each vehicle:

c) using a respective actuator to generate a vibration in the relevant vibratory system;

d) using a respective sensor to record the generated vibration in the relevant vibratory system as a measurement result for the released state for the relevant vehicle;

and at least one of:

e) carrying out a computer-aided comparison of each first measurement result with a first reference result for the released state, or carrying out a computer-aided comparison of each second measurement result with a second reference result for the applied state, or carrying out a computer-aided comparison of each first measurement result with the relevant second measurement result and comparing an ascertained difference result with a third reference result for a difference; and f) upon a deviation, lying outside of an admissible tolerance range, being established between at least one of the measurement results or the difference results as well as the associated one of the reference results, generating a computer-aided error signal.

2. The method according to claim 1, which further comprises using the actuator to generate a specified vibration pulse as a vibration, and using the sensor to subsequently record a pulse response of the vibratory system as a generated vibration.

3. The method according to claim 1, which further comprises using the actuator to generate a specified vibration profile as a vibration, and using the sensor to record a vibration response of the vibratory system at least one of during the generation of the vibration or subsequently as a generated vibration.

4. The method according to claim 1, which further comprises carrying out a computer-aided processing of each measurement result before carrying out step d).

5. The method according to claim 4, which further comprises processing each measurement result to represent a measure of a resonance frequency of the vibratory system.

6. The method according to claim 4, which further comprises processing each measurement result to represent a frequency spectrum.

7. The method according to claim 4, which further comprises processing each measurement result to represent a measure of a damping of the vibratory system.

8. The method according to claim 1, which further comprises:

g) creating at least one of first reference results or second reference results or third reference results for a specified large number of brake types or for a specified large number of pairings between brake types and vehicle types; and h) for each vehicle, storing at least one of a particular first reference result or second reference result or third reference result for retrieval when necessary by taking into account the brake type used in the vehicle or by taking into account the brake type used and also the vehicle type.

9. The method according to claim 8, which further comprises:

i) individually ascertaining at least one of a first reference result or a second reference result or a third reference result for at least one vehicle; and j) for each vehicle, storing at least one of the ascertained first reference result or second reference result or third reference result for retrieval when necessary.

10. The method according to claim 9, which further comprises:

k) storing at least one of first error results or second error results or third error results for an occurrence of typical types of error ascertainable during the brake test;

l) upon generating the error signal in step f) at least one of:

carrying out a computer-aided comparison of the relevant first measurement result with the first error results, or carrying out a computer-aided comparison of the relevant second measurement result with the second error results, or carrying out a computer-aided comparison of the ascertained difference result with the third error results; and m) upon establishing a match between at least one of one of the measurement results or one of the difference results and an associated error result in a context of specified deviations, carrying out a computer-aided generation of an error message describing the relevant type of error.

11. The method according to claim 1, which further comprises using at least one of redundant actuators or sensors for each vibratory system of at least one of the vehicles.

12. A rail-guided vehicle having wheels and brakes forming a vibratory system, the rail-guided vehicle comprising:

an actuator for generating a vibration in the vibratory system of a relevant vehicle;

a sensor for recording the generated vibration in the relevant vibratory system as a first measurement result in an applied state of the brakes for the relevant vehicle;

the actuator subsequently generating a vibration in the relevant vibratory system in a released state of the brakes in each vehicle;

the respective sensor recording the generated vibration in the relevant vibratory system as a measurement result for the released state for the relevant vehicle; and a computing environment with a computer for at least one of:

carrying out a computer-aided comparison of each first measurement result with a first reference result for the released state, or carrying out a computer-aided comparison of each second measurement result with a second reference result for the applied state, or carrying out a computer-aided comparison of each first measurement result with the relevant second measurement result and comparing an ascertained difference result with a third reference result for a difference; and upon a deviation, lying outside of an admissible tolerance range, being established between at least one of the measurement results or the difference results as well as the associated one of the reference results, generating a computer-aided error signal.

13. A non-transitory computer program product, comprising program commands which upon executing the program on a computer in a computing environment, prompt the computer to:

carry out a computer-aided comparison of each first measurement result, of vibrations generated by an actuator in a vibratory system including brakes and wheels of a vehicle recorded by a sensor, with a first reference result for a released state of the brakes in the vehicle, or carry out a computer-aided comparison of each second measurement result of vibrations generated by the actuator in the vibratory system recorded by the sensor, with a second reference result for an applied state of the brakes in the vehicle, or carry out a computer-aided comparison of each first measurement result with a relevant second measurement result and compare an ascertained difference result with a third reference result for a difference; and upon a deviation, lying outside of an admissible tolerance range, being established between at least one of one of the measurement results or the difference results as well as the associated one of the reference results, generate a computer-aided error signal.

14. A non-transitory computer-readable storage medium for data, the storage medium storing datasets of the computer program product according to claim 13.

* * * * *